US008682217B2

(12) United States Patent
Murashima

(10) Patent No.: US 8,682,217 B2
(45) Date of Patent: Mar. 25, 2014

(54) IMAGE FORMING APPARATUS

(75) Inventor: Masaki Murashima, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 175 days.

(21) Appl. No.: 13/334,660

(22) Filed: Dec. 22, 2011

(65) Prior Publication Data

US 2012/0163863 A1 Jun. 28, 2012

(30) Foreign Application Priority Data

Dec. 27, 2010 (JP) ..... 2010-289143

(51) Int. Cl.
*G03G 15/08* (2006.01)
*G03G 21/16* (2006.01)

(52) U.S. Cl.
CPC ..... *G03G 21/1661* (2013.01); *G03G 21/168* (2013.01); *G03G 21/1695* (2013.01); *G03G 21/1633* (2013.01); *G03G 21/1647* (2013.01); *G03G 2221/1642* (2013.01)
USPC ..... 399/121; 399/316; 399/388

(58) Field of Classification Search
CPC ..... G03G 21/168; G03G 21/1647
USPC ..... 399/121, 316, 388
See application file for complete search history.

(56) References Cited

U.S. PATENT DOCUMENTS 5,339,132 A 8/1994 Tomita et al.
2002/0106224 A1 8/2002 Yamauchi et al.
2004/0013452 A1 1/2004 Choi
2005/0019068 A1 1/2005 Yamauchi et al.
2005/0260015 A1 11/2005 Ito
2007/0080493 A1 4/2007 Kim
2007/0091157 A1* 4/2007 Ito ..... 347/104
2007/0127947 A1 6/2007 Kuma et al.
2007/0212108 A1 9/2007 Hozono et al.
2009/0129815 A1* 5/2009 Kouzu ..... 399/121
2010/0278557 A1* 11/2010 Somemiya et al. ..... 399/124

FOREIGN PATENT DOCUMENTS

JP H05-238058 A 9/1993
JP 2000-162893 A 6/2000
JP 2002-278317 A 9/2002
JP 2007-156271 A 6/2007

OTHER PUBLICATIONS

English abstract for JPH05-238058.
English abstract for JP2002-278317.

(Continued)

*Primary Examiner* — Benjamin Schmitt

(57) ABSTRACT

An image forming apparatus include a main body and a conveyance unit. The main body includes an image carrier forming a toner image on a surface, a roller locating portion formed on both axial ends of the image carrier, and a guide locating portion formed in proximity to the roller locating portion. The conveyance unit is mounted to open and close on the main body, and includes a transfer roller unit, a conveyance guide, and a biasing member. The transfer roller unit has a transfer roller forming a transfer nip portion with the image carrier, and a separation lever configured to provide pivotal support for the transfer roller and being disposed to rotate. The conveyance guide is configured to guide a sheet of paper to the transfer nip portion, includes a regulating portion. The biasing member is configured to bias the conveyance guide toward the guide locating portion.

8 Claims, 14 Drawing Sheets

(56) References Cited

OTHER PUBLICATIONS

Extended European Search Report issued in European Application No. 11195224.8, dated Jun. 12, 2012.

English Machine Translation of JP 2007-156271.

Machine (English) Translation of Japanese Publication No. 2000-162893.

* cited by examiner

IMAGE FORMING APPARATUS

This application is based on and claims the benefit of priority from Japanese Patent Application No. 2010-289143, filed on 27 Dec. 2010, the content of which is incorporated herein by reference.

BACKGROUND OF THE DISCLOSURE

1. Field of the Disclosure

The present disclosure relates to an image forming apparatus.

2. Related Art

Conventionally, a so-called electrographic type of image forming apparatus includes a type in which a conveyance unit provided with a transfer roller is mounted in an opening and closing configuration on a main body provided with an image carrier that forms a toner image on a surface thereof. This type of image forming apparatus is configured to bring the transfer roller into abutment with the image carrier by placing the conveyance unit in a closed state, and to thereby form a transfer nip portion for transfer of the resulting toner image onto a sheet of paper.

Normally, an image forming apparatus with the above configuration has a transfer roller forward conveyance guide for guiding the paper sheet to the transfer nip portion. When the conveyance guide is fixed to the main body, although accurate locating of the conveyance guide is enabled, on the other hand, releasing a jam (paper jam) is difficult.

A configuration is known in which the conveyance guide is fixed to the conveyance unit, and when the conveyance unit is in a closed state, the conveyance guide fixed to the conveyance unit is displaced towards the main body, abuts with a position locating portion of the main body and thereby locates the position of the conveyance guide on the main body. By adopting this type of configuration, the image forming apparatus can ensure operation characteristics in relation to releasing a jam, and can reduce deviation in the disposition of the conveyance guide resulting from component deviation of the conveyance unit.

A configuration in a related technique is known in which a locating projection provided in proximity to the conveyance guide is inserted into a locating hole provided on the main body in response to the closing operation of the conveyance unit to thereby position the conveyance guide on the main body.

However, since neither of the above techniques forms an operable connection between the operation of the transfer roller and the conveyance guide during the locating operation, the locating of the conveyance guide is not stable or accurate. Therefore, guiding of paper by the conveyance guide is not accurate, and as a result, there is the possibility of unsatisfactory image quality, a paper jam, and malfunction in relation to the opening and closing operations of the conveyance unit.

SUMMARY OF THE DISCLOSURE

The present disclosure has the object of providing an image forming apparatus enabling stable abutment of the conveyance guide with a guide locating portion provided on the main body.

This disclosure relates to an image forming apparatus comprising a main body and a conveyance unit.

The main body includes an image carrier, a roller locating portion, and a guide locating portion.

The image carrier has one or a plurality of mutually parallel shafts and forming a toner image on a surface.

The roller locating portion is formed on both axial ends of the image carrier.

The guide locating portion is formed in proximity to the roller locating portion.

The conveyance unit is mounted to open and close on the main body, and includes a transfer roller unit, a conveyance guide, and a biasing member.

The transfer roller unit has a transfer roller abutting with image carrier and forming a transfer nip portion with the image carrier, and a separation lever configured to provide pivotal support for the transfer roller and being disposed to rotate.

The conveyance guide is configured to guide a sheet of paper to the transfer nip portion, includes a regulating portion and is disposed to rotate.

The biasing member is configured to bias the conveyance guide toward the guide locating portion.

DETAILED DESCRIPTION OF THE DISCLOSURE

A color printer 1 will be described below as an image forming apparatus according to a first embodiment of the present disclosure making reference to FIG. 1 to FIG. 14. The front face illustrated in FIG. 1 and FIG. 2 will be described below as the front surface of the color printer 1. The right/left positional relationship of each member in FIG. 3, FIG. 4, FIG. 7 and FIG. 8 is inverted with respect to that illustrated in FIG. 1 and FIG. 2.

The color printer 1 includes a main body 2 in which an outer periphery is covered by an external cover (not shown) and a conveyance unit 3 mounted to open and close on a left surface of the main body 2.

Figure 1:
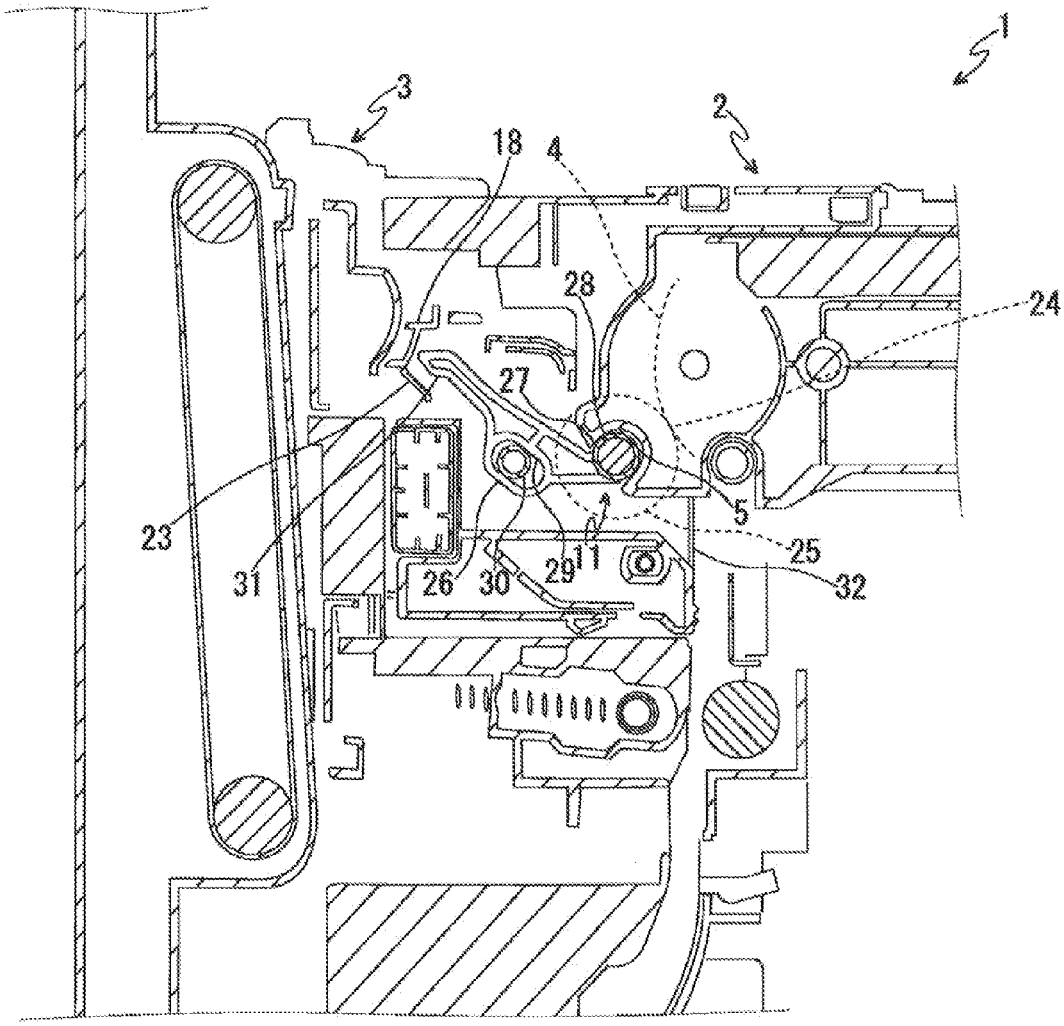
FIG. 1 is a sectional view of an image forming apparatus according to an embodiment of the present disclosure, and illustrates a section passing through a roller locating portion in a closed state in which the opening and closing lever has not been pulled.
Figure 2:
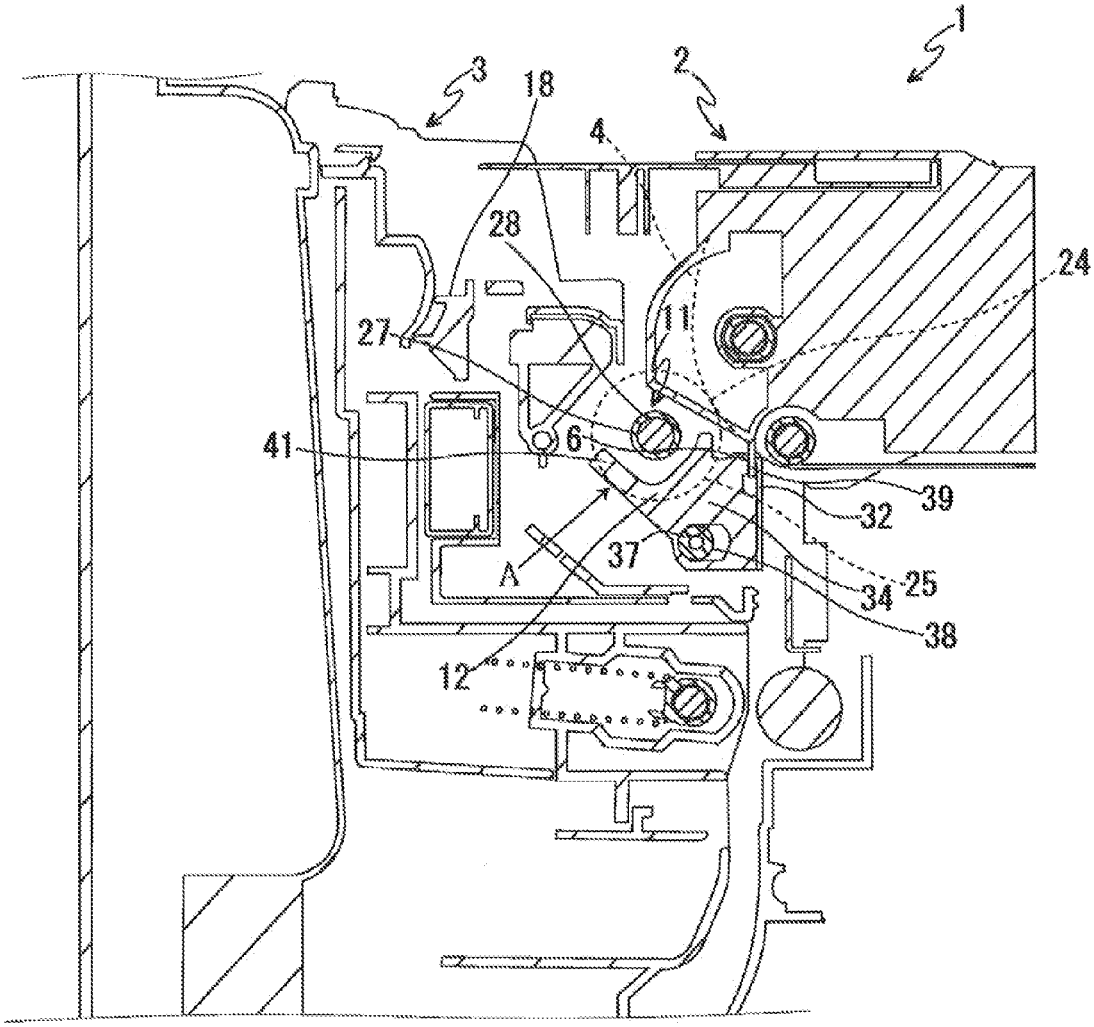
FIG. 2 is a sectional view of an image forming apparatus according to an embodiment of the present disclosure, and illustrates a section passing through a guide locating portion in a closed state in which the opening and closing lever has not been pulled.
Figure 3:
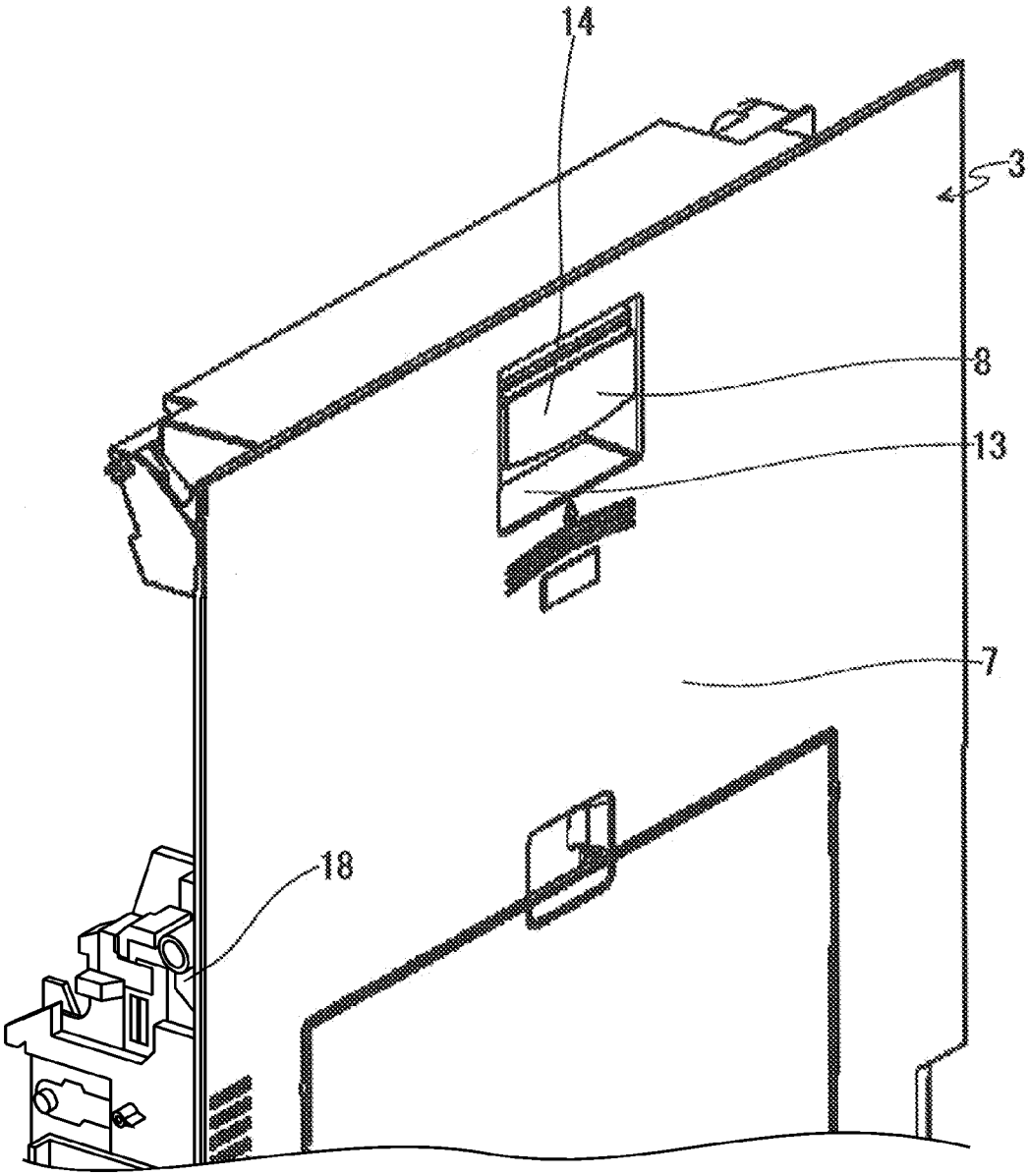
FIG. 3 is a perspective view of an image forming apparatus according to an embodiment of the present disclosure, and illustrates a conveyance unit in a closed state in which the opening and closing lever has not been pulled.

In FIG. 1 and the like, an intermediate transfer belt 4 that configures an image carrier is supported horizontally from the left portion to the right portion in an inner portion of the main body 2. In this embodiment, the intermediate transfer belt 4 includes a plurality of shafts that extend in a vertical direction with respect to the sheet of paper of FIG. 1. The plurality of shafts is disposed in a mutually parallel configuration. More precisely, the intermediate transfer belt 4 is formed in a circular configuration. The intermediate transfer belt 4 is suspended on a plurality of rotating rollers disposed on an inner surface in a circular configuration. The intermediate transfer belt 4 is rotated in a circular direction by the plurality of rotating rollers rotating about a shaft (axis). The intermediate transfer belt 4 may be described as rotating about an axis in a region abutting with the rotating roller. The transfer roller may be used as the image carrier. The transfer roller has a single shaft and rotates about that shaft (axis). In each figure, only the left end of the intermediate transfer belt 4 is displayed by a dotted line.

An roller locating portion 5 which is indented portion is formed in the main body 2 on both ends with respect to an axial direction of the intermediate transfer belt 4 (a longitudinal direction in the present embodiment) (refer to FIG. 1). The roller locating portion 5 is formed in a semi-arc shape opening towards the lower left when viewed in section. The guide locating portion 6 which is flat face is disposed to extend in a substantially perpendicular direction in proximity to the roller locating portion 5 on the main body 2 (more on an inner axial direction than the roller locating portion 5) (refer to FIG. 2).

Although omitted from the figures, an image forming unit is provided for respective colors on the main body 2. The image forming unit includes a photosensitive drum that abut with the intermediate transfer belt 4 and form a primary transfer nip portion, a charging device that applies a charge to a predetermined voltage to the surface of each photosensitive drum, an exposure device that exposes light onto the surface of each photosensitive drum that has been charged by the charging device to thereby form an electrostatic latent image, a development device that uses toner to develop the electrostatic latent image formed by the exposure device into a toner image, and a primary transfer roller that operates cooperatively with the photosensitive drum to execute primary transfer of the toner image onto the surface of the intermediate transfer belt 4.

The conveyance unit 3 is configured to open and close with respect to the main body 2 by revolving (rotating) about a support point (not shown) provided on a lower end portion. The conveyance unit 3 is configured to be displaceable between a closed state and an open state.

The conveyance unit 3 includes a left cover 7 that covers the left surface of the main body 2, an opening and closing lever 8 that is mounted on an upper portion of the left cover 7, a transfer roller unit 11 connected with the opening and closing lever 8 though a link mechanism 10, and a conveyance guide 12 provided below the transfer roller unit 11.

Figure 4:
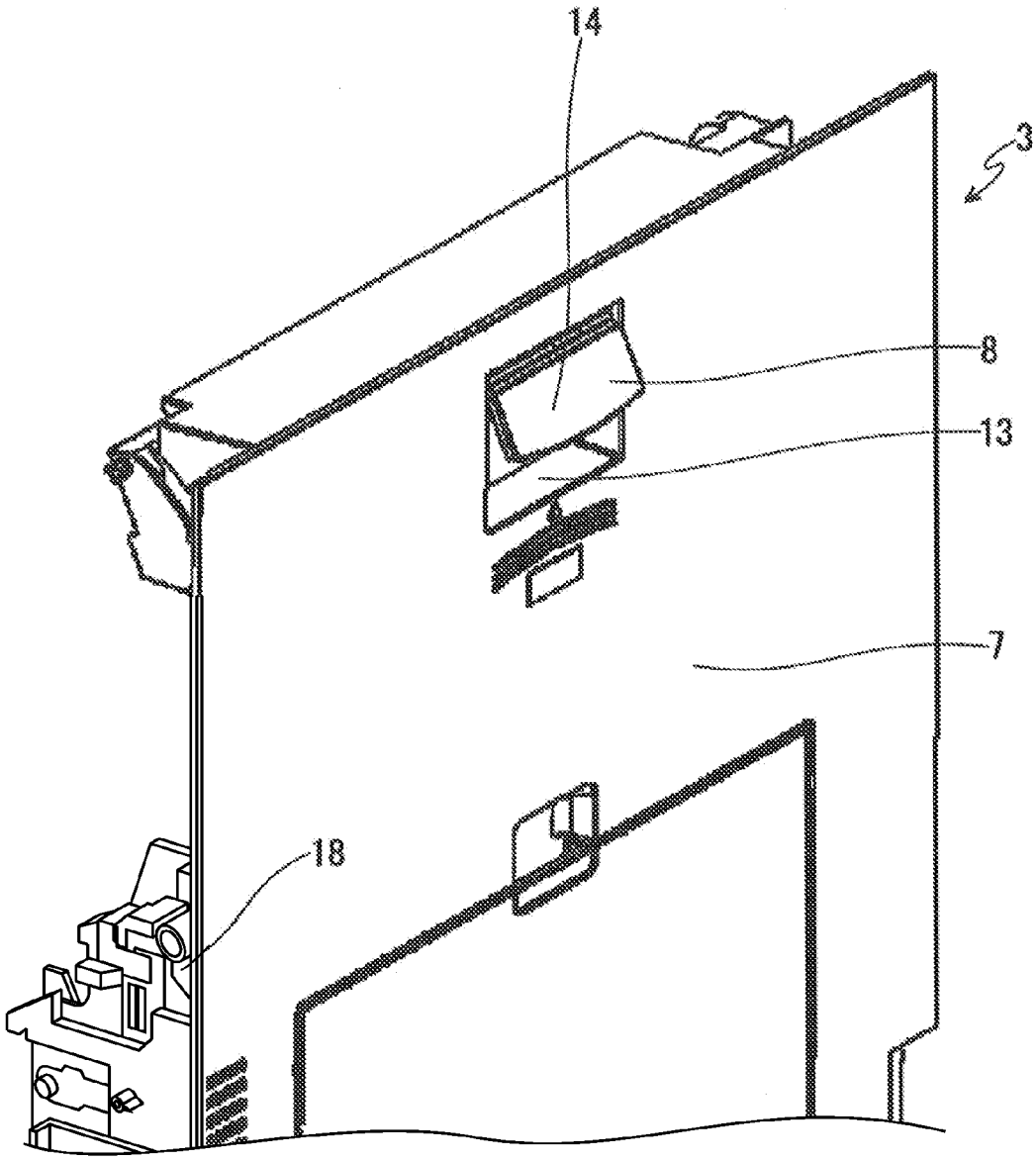
FIG. 4 is a perspective view of an image forming apparatus according to an embodiment of the present disclosure, and illustrates a conveyance unit in a closed state in which the opening and closing lever has been pulled.
Figure 5:
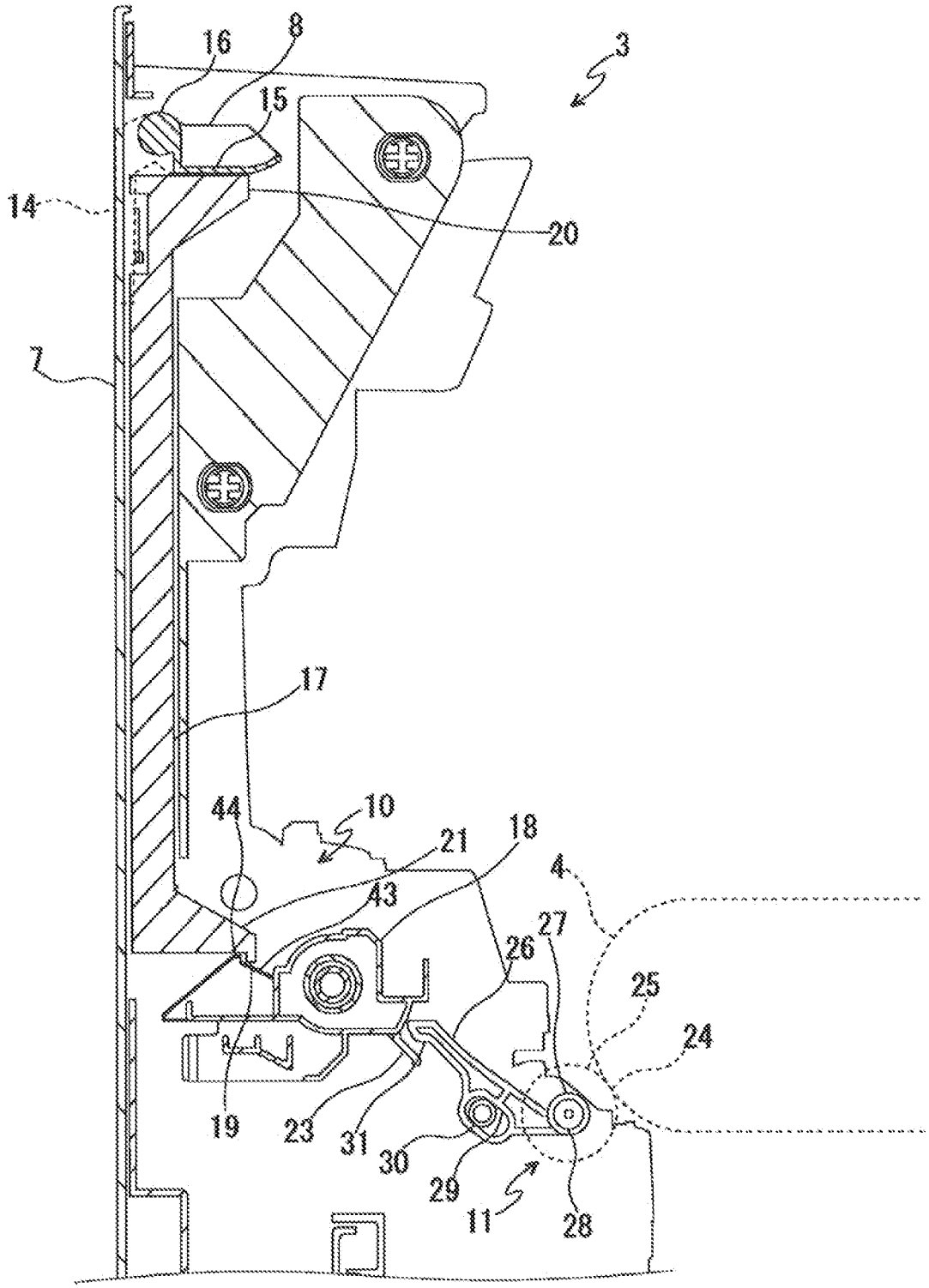
FIG. 5 is a sectional view of an image forming apparatus according to an embodiment of the present disclosure, and illustrates a conveyance unit in a closed state in which the opening and closing lever has not been pulled.
Figure 6:
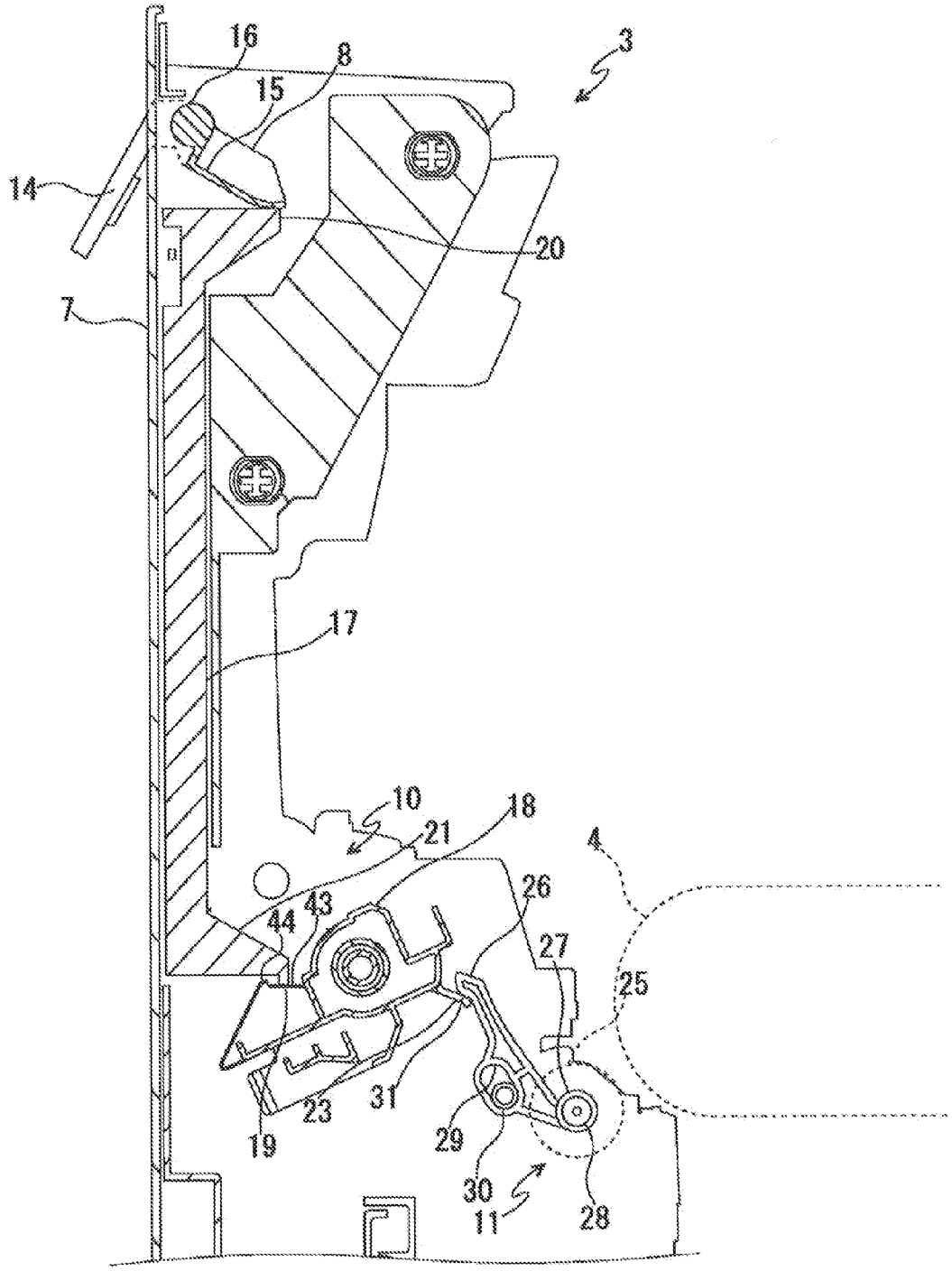
FIG. 6 is a sectional view of an image forming apparatus according to an embodiment of the present disclosure, and illustrates a conveyance unit in a closed state in which the opening and closing lever has been pulled.

As illustrated in FIG. 5 and FIG. 6, the opening and closing lever 8 is configured to be in the shape of a letter "L" when viewed in cross section. The opening and closing lever 8 includes a handle 14 disposed in an indented portion 13 (refer to FIG. 3 and FIG. 4) formed on an upper portion of the outer surface (left surface) of the left cover 7, a pressing portion 15 curving to the right from an upper end of the handle 14, and a support portion 16 mounted in proximity to a connecting portion with the handle 14 and the pressing portion 15. The opening and closing lever 8 is supported on the conveyance unit 3 to rotate about the support portion 16. The opening and closing lever 8 is operably connected with a hook (not illustrated) that engages with an engaging portion (not illustrated) formed on the main body 2 to thereby maintain the conveyance unit 3 in a closed state.

The link mechanism 10 includes a link member 17 provided below the opening and closing lever 8 and a lock lever 18 provided from below the link member 17 to the lower right.

The link member 17 is provided along the inner surface (right surface) of the left cover 7. The link member 17 is supported to shift vertically on the conveyance unit 3.

An upper end projection 20 is provided towards the right on an upper end of the link member 17. The upper surface of the upper end projection 20 abuts with the lower surface of the pressing portion 15 of the opening and closing lever 8.

A lower end projection 21 is provided towards the right on a lower end of the link member 17. A pressing projection 19 is provided in a downward configuration on a right end of the lower end projection 21.

The lock lever 18 is supported to revolve (rotate) on the conveyance unit 3. A torsion spring (not illustrated) is housed in the lock lever 18 and a spring pressure is applied by the torsion spring to place the lock lever 18 in a horizontal state (refer to FIG. 5).

An inclined surface 43 is provided at a position on the upper left portion of the lock lever 18 corresponding to the pressing projection 19 of the link member 17. A projecting engagement portion 44 is provided to the left of the inclined surface 43. A raising projection 23 is provided towards the lower right on the right end portion of the lock lever 18.

The transfer roller unit 11 includes a secondary transfer roller 25 provided to abut with the intermediate transfer belt 4, and a separation lever 26 provided on both ends in an axial direction of the secondary transfer roller 25 (in the longitudinal direction in the present embodiment).

The secondary transfer roller 25 forms a secondary transfer nip portion 24 with the intermediate transfer belt 4. A toner image that is subjected to primary transfer onto the surface of the intermediate transfer belt 4 by the primary transfer roller (not illustrated) can be secondarily transferred to a sheet of paper by the secondary transfer nip portion 24.

A pivotal supporting portion 27 which is circular shape is provided on a right end of the separation lever 26. The secondary transfer roller 25 is pivotally supported on the separation lever 26 by insertion of both longitudinal ends of the rotation shaft 28 of the secondary transfer roller 25 into the pivotal support portion 27.

An elongated hole 29 is provided in a central portion in the transverse direction of the separation lever 26. The separation lever 26 is retained to revolve (rotate) about a projection 30 by engagement of the boss-shaped projection 30 provided on both longitudinal ends of the conveyance unit 3 in the elongated hole 29. An engaging portion 31 is provided on the left end portion of the separation lever 26 at a position corresponding to the raising projection 23 of the lock lever 18.

Figure 7:
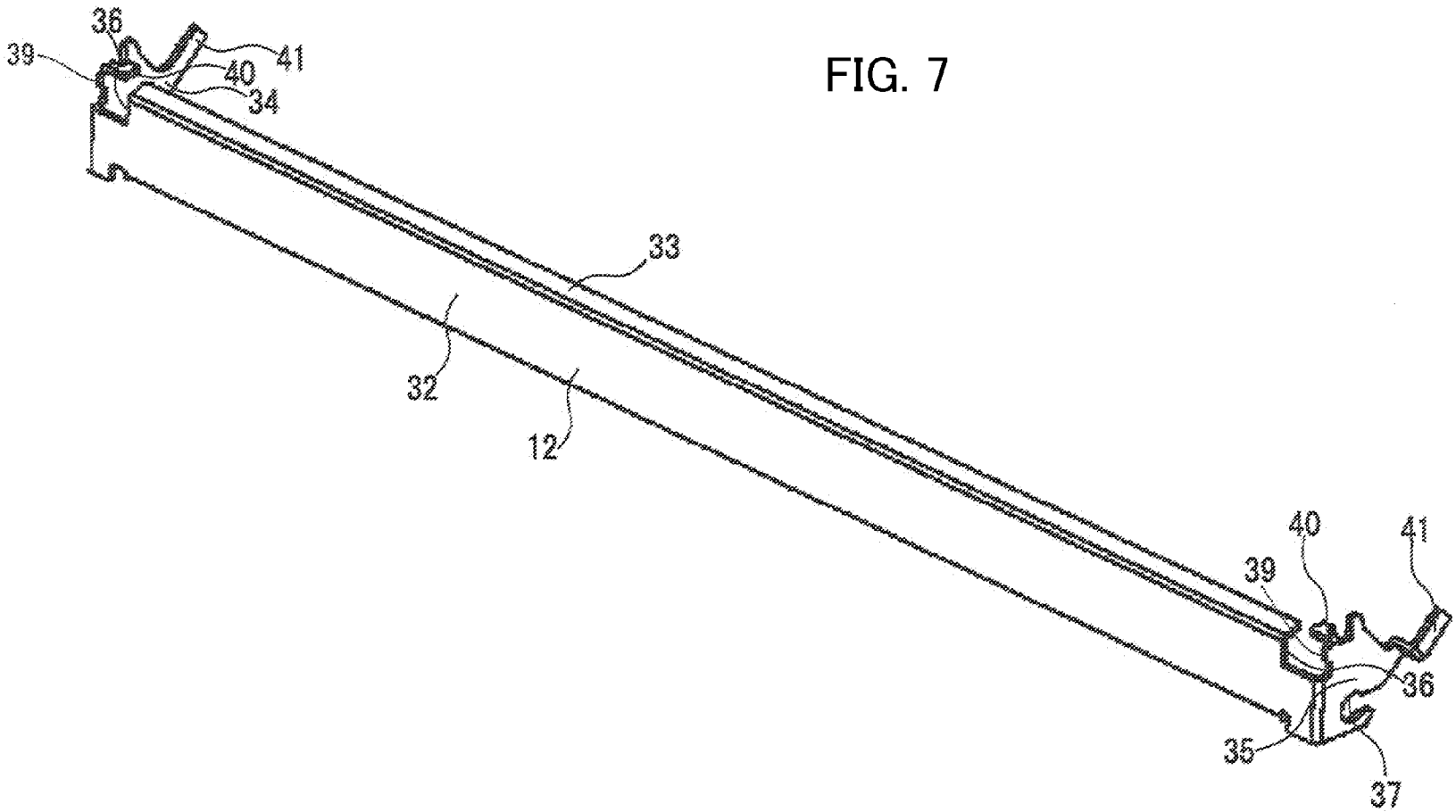
FIG. 7 is a perspective view of an image forming apparatus according to an embodiment of the present disclosure, and illustrates a conveyance guide.

The conveyance guide 12 is biased towards the guide locating portion 6 (refer to the arrow in FIG. 2) by the torsion spring (not illustrated) that acts as a biasing member provided on the conveyance unit 3. As illustrated in FIG. 7, the conveyance guide 12 includes a guide plate 32 elongated in a longitudinal direction, an upper end curved plate 33 provided from the upper end of the guide plate 32 towards an upper left direction, and both end curved plates 34, 35 that are orientated towards the left respectively on both ends in a longitudinal direction of the guide plate 32.

Figure 8:
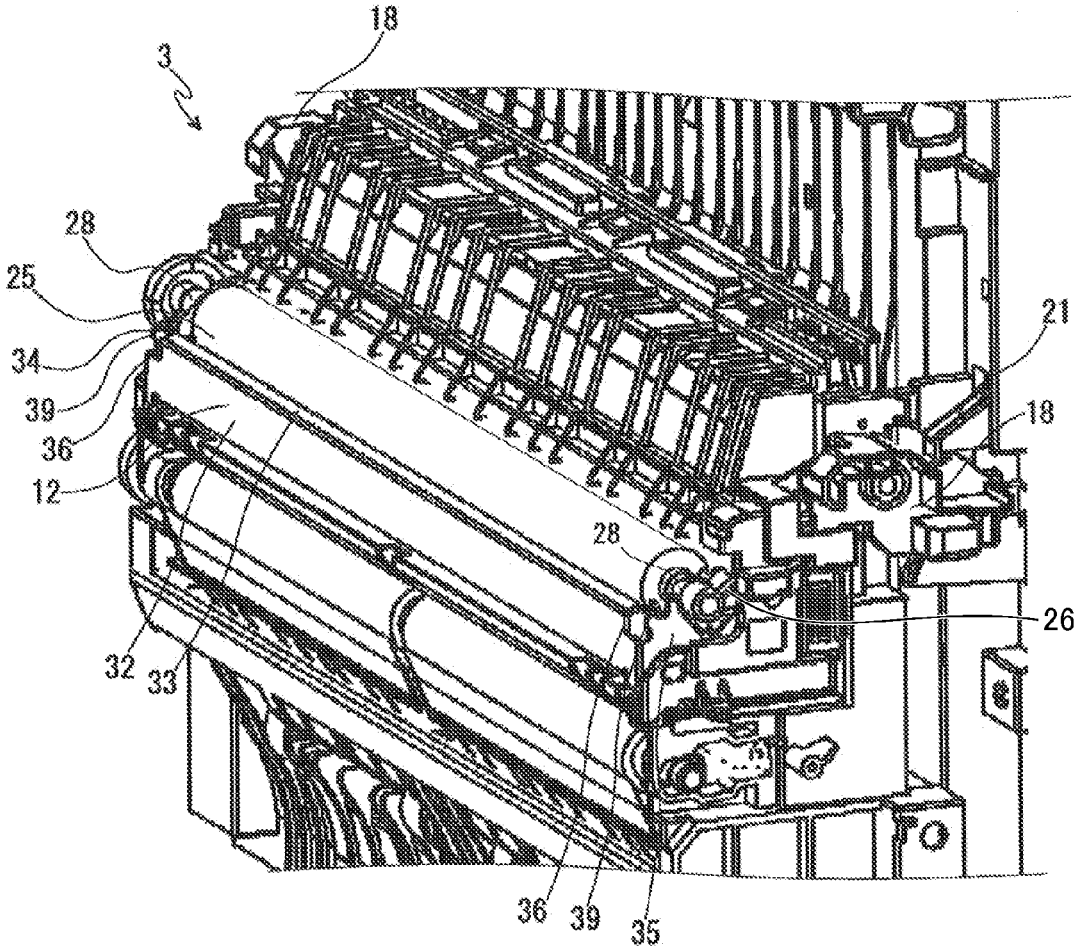
FIG. 8 is a perspective view of an image forming apparatus according to an embodiment of the present disclosure, and illustrates a conveyance unit showing the periphery of a secondary transfer roller.

The guide plate 32 is disposed in a substantially perpendicular orientation (a configuration in which the planar direction is parallel to the vertical direction) (refer to FIG. 8). The guide plate 32 is configured so that a sheet of paper that is conveyed from below the conveyance guide 12 rises along the right surface of the guide plate 32 and is guided to the secondary transfer nip portion 24. A notched portion 36 is provided on both ends in a longitudinal direction of the upper end curved plate 33 and the guide plate 32 from the upper portion of the guide plate 32 towards the upper end curved plate 33.

An engaging hole 37 is provided in a horizontal configuration on a lower portion each of the both end curved plates 34, 35. The conveyance guide 12 is supported to revolve (rotate) on a conveyance unit 3 by engagement of the boss 38 (refer to FIG. 2) provided on both longitudinal ends of the conveyance unit 3 with the engaging hole 37. The engaging hole 37 of the forward end curved plate 34 is formed as an elongated hole (refer to FIG. 2), and the engaging hole 37 of the rear end curved plate 35 is formed as a precise circle, and includes an open portion that has a smaller width than the diameter (refer to FIG. 7). Furthermore, the forward-end boss 38 is cylindrical, and a portion of the peripheral surface of the cylinder of the rear-end boss 38 is cut to form a width that enables passage of the open portion of the rear end curved plate 35. In this configuration, firstly the boss 38 is inserted into the engaging hole 37 of the forward-end curved plate 34, the rear end boss 38 is aligned and inserted into the open portion of the engaging hole 37 of the rear end curved plate 35, and thereby enables simple mounting of the conveyance guide 12 on the conveyance unit 3. Furthermore, in the present embodiment, one longitudinal end of the conveyance guide 12 is rotatably supported on the conveyance unit 3, and the other end is supported to rotate on the conveyance unit 3 and shifts in a predetermined direction.

An abutment piece 39 is oriented toward the right on an upper end of the right edge each of the both end curved plates 34, 35. A curved piece 40 is oriented toward the notched portion 36 on a right end of the upper edge portion each of the both end curved plates 34, 35. One end of the torsion spring is engaged with the curved piece 40 and biases the conveyance guide 12 towards the guide locating portion 6. A regulating portion 41 is oriented towards the upper left on the left end each of the both end curved plates 34, 35. The regulating portion 41 of the forward end curved plate 34 is provided in a flat plate shape, and the regulating portion 41 of the rear end curved plate 35 curves in the shape of a letter L (refer to FIG. 7).

The operation of displacing the conveyance unit 3 from a closed state to an open state with reference to the configuration described above will be described below mainly with reference to FIG. 1, FIG. 2 and FIG. 9 to FIG. 14.

Firstly, as illustrated in FIG. 1, when the conveyance unit 3 is in a closed state, the pivotal supporting portion 27 is disposed at a position engaging with the roller locating portion 5 to thereby position the secondary transfer roller 25. The secondary transfer nip portion 24 is formed by abutment with a predetermined pressure of the secondary transfer roller 25 with the intermediate transfer belt 4. As illustrated by the arrow A in FIG. 2, the conveyance guide 12 is pressed by the torsion spring (not illustrated) towards the guide locating portion 6 of the main body 2, and the conveyance guide 12 is located by abutment of the abutment piece 39 of the conveyance guide 12 at a predetermined pressure with the guide locating portion 6. The pivotal supporting portion 27 of the separation lever 26 separates from the regulating portion 41 of the conveyance guide 12.

Figure 9:
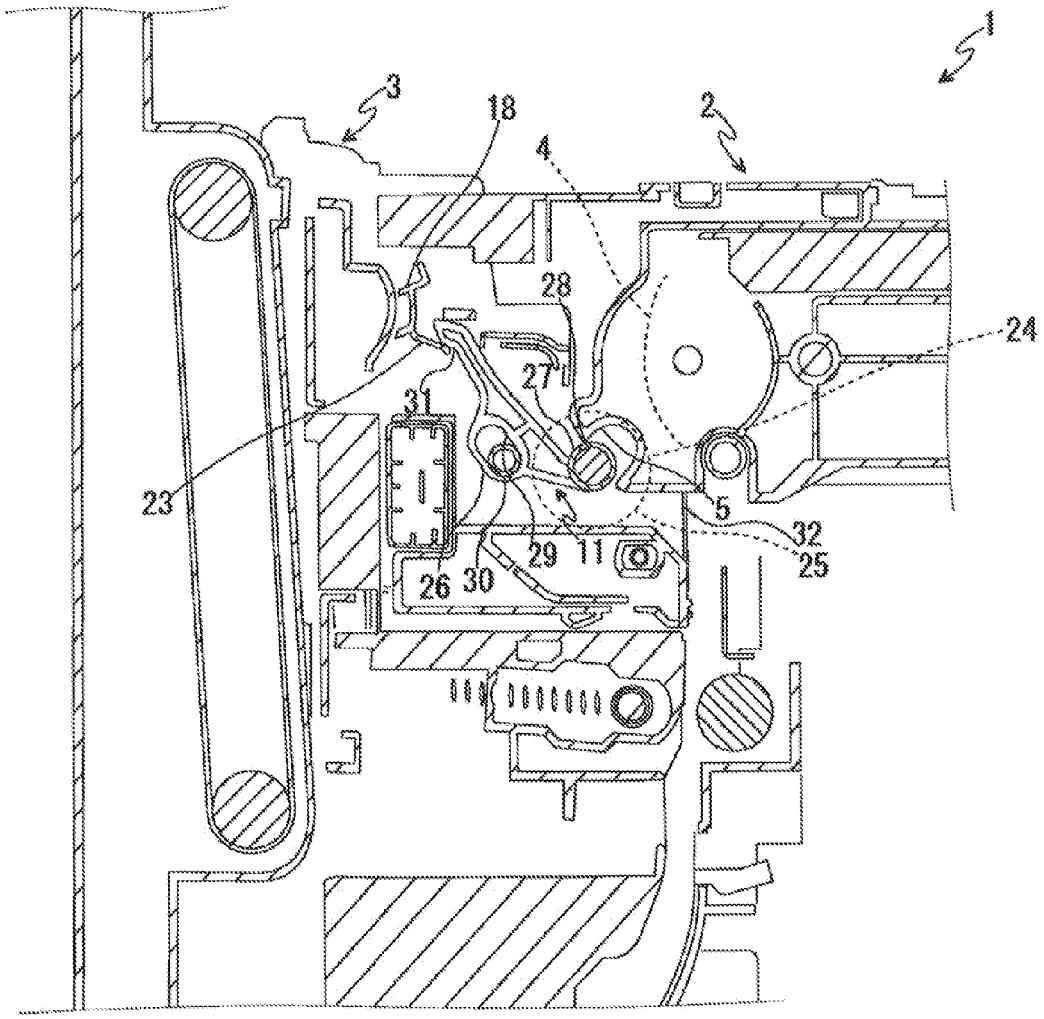
FIG. 9 is a sectional view of an image forming apparatus according to an embodiment of the present disclosure, and illustrates a section passing through a roller locating portion in a closed state in which the opening and closing lever has been pulled.
Figure 10:
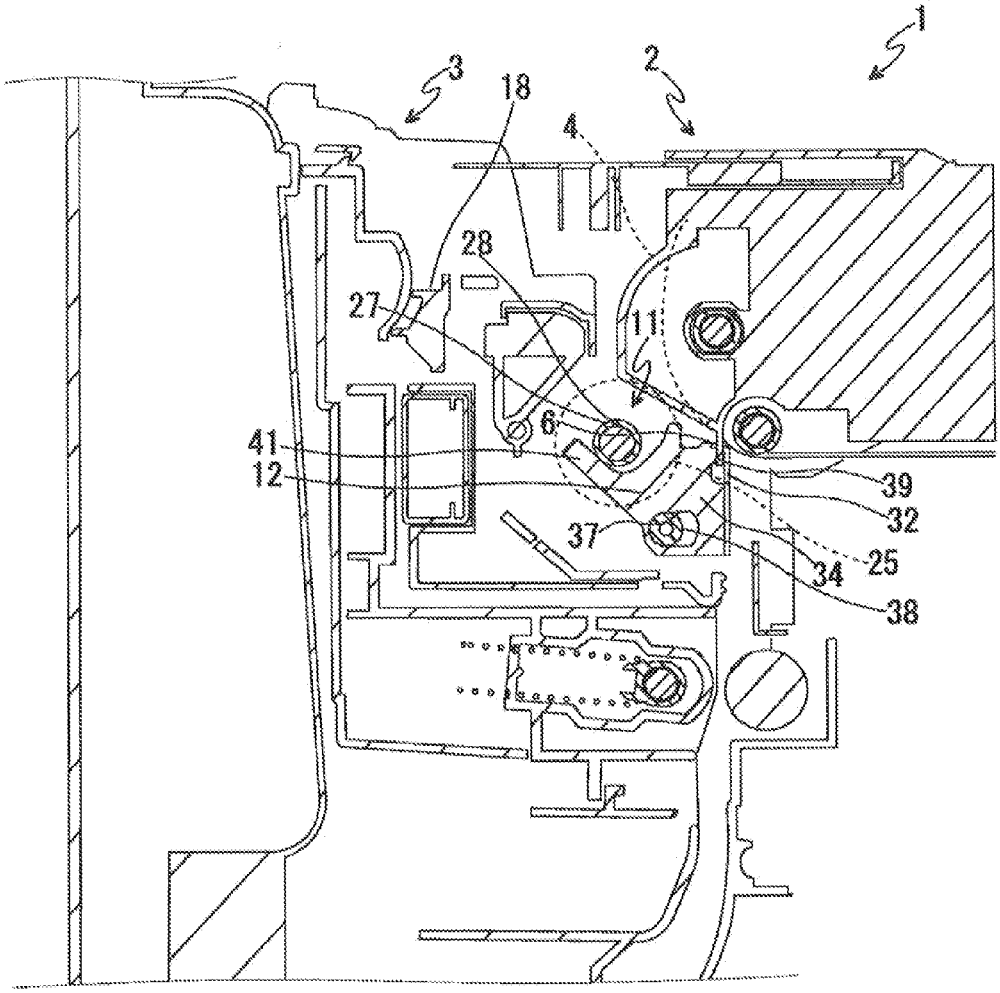
FIG. 10 is a sectional view of an image forming apparatus according to an embodiment of the present disclosure, and illustrates a section passing through a guide locating portion in a closed state in which the opening and closing lever has been pulled.

As illustrated in FIG. 4, when the handle 14 of the opening and closing lever 8 is pulled by a user from this state, the opening and closing lever 8 revolves (rotates) about the support portion 16 as illustrated in FIG. 6, and the pressing portion 15 of the opening and closing lever 8 depresses the upper end projection 20 of the link member 17 downwardly. In this manner, the link member 17 is lowered, the pressing projection 19 of the link member 17 presses the inclined surface 43 of the lock lever 18 downwardly. Then, the lock lever 18 revolves (rotates). The revolving (rotation) of the lock lever 18 raises the raising projection 23 of the lock lever 18 and the engaging portion 31 of the separation lever 26 is pressed upwardly. As a result, the separation lever 26 revolves (rotates) about the projection 30 and is pressed upwardly. As illustrated in FIG. 9, in this manner, the pivotal supporting portion 27 of the separation lever 26 displaces by revolving (rotating) from the engaging position with the transfer roller locating portion 5 to the separation position. As illustrated in FIG. 10, the pivotal supporting portion 27 of the separation lever 26 abuts with the regulating portion 41 of the conveyance guide 12.

Figure 11:
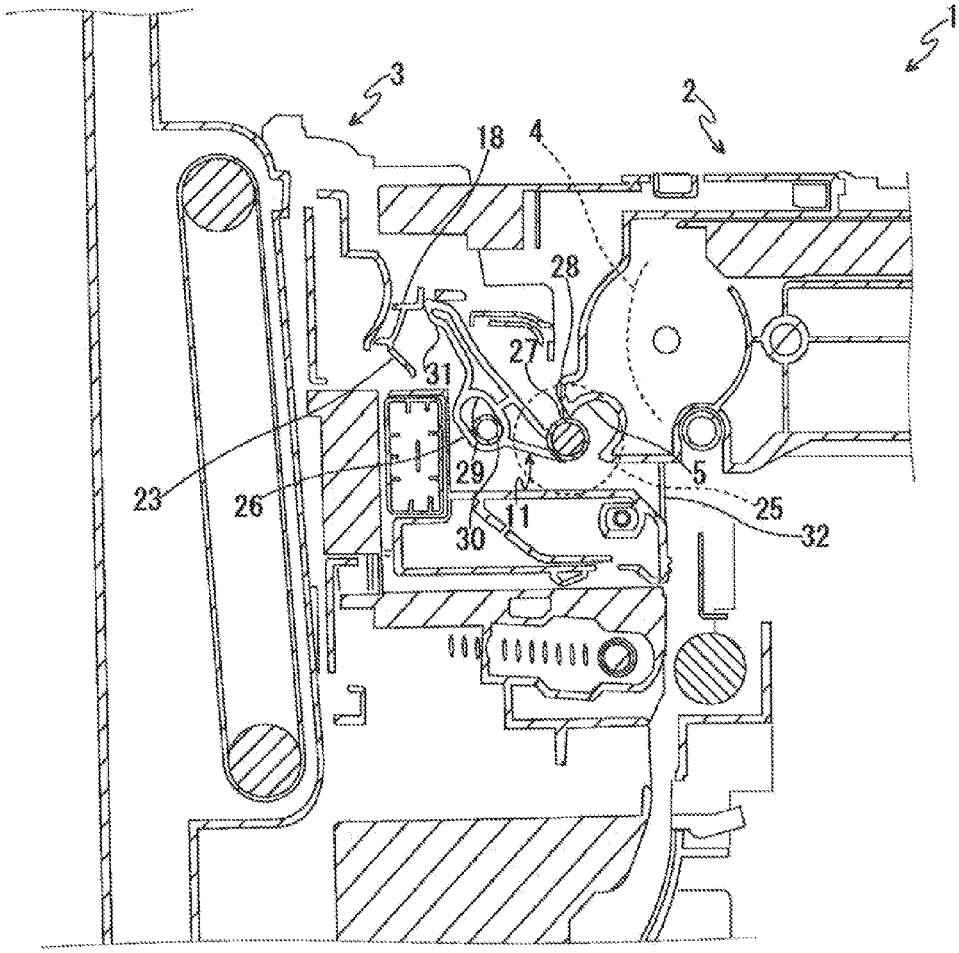
FIG. 11 is a sectional view of an image forming apparatus according to an embodiment of the present disclosure, and illustrates a section passing through a roller locating portion in a state in which the conveyance unit is slightly open.
Figure 12:
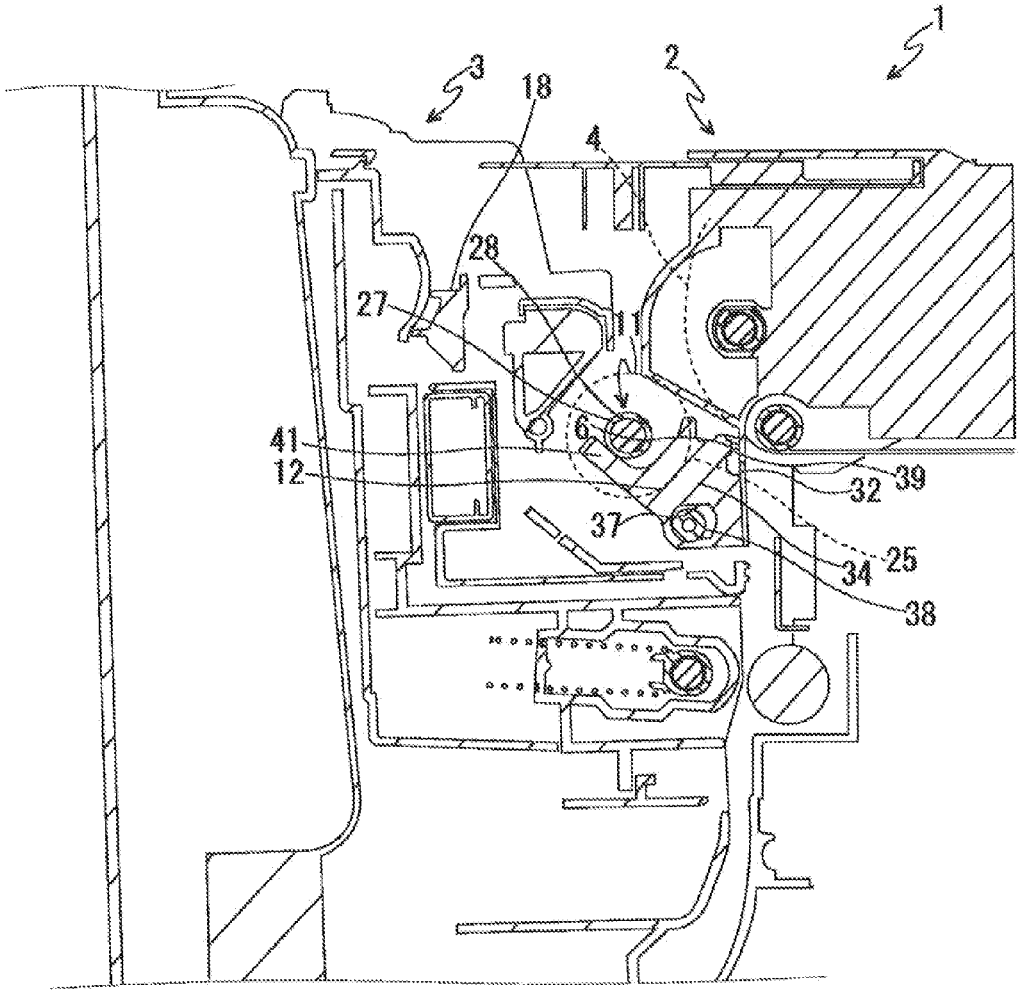
FIG. 12 is a sectional view of an image forming apparatus according to an embodiment of the present disclosure, and illustrates a section passing through a guide locating portion in a state in which the conveyance unit is slightly open.

When the handle 14 of the opening and closing lever 8 is pulled by a user in this manner and the conveyance unit 3 revolves (rotates) to become slightly opened, the pivotal supporting portion 27 of the separation lever 26 is pressed downwardly while sliding along the roller locating portion 5, and as illustrated in FIG. 11, displaces to the outer side of the roller locating portion 5. At the same time, as illustrated in FIG. 12, the conveyance guide 12 is pressed down by the pivotal supporting portion 27 of the separation lever 26, and the abutment piece 39 of the conveyance guide 12 separates from the guide locating portion 6 of the main body 2.

Figure 13:
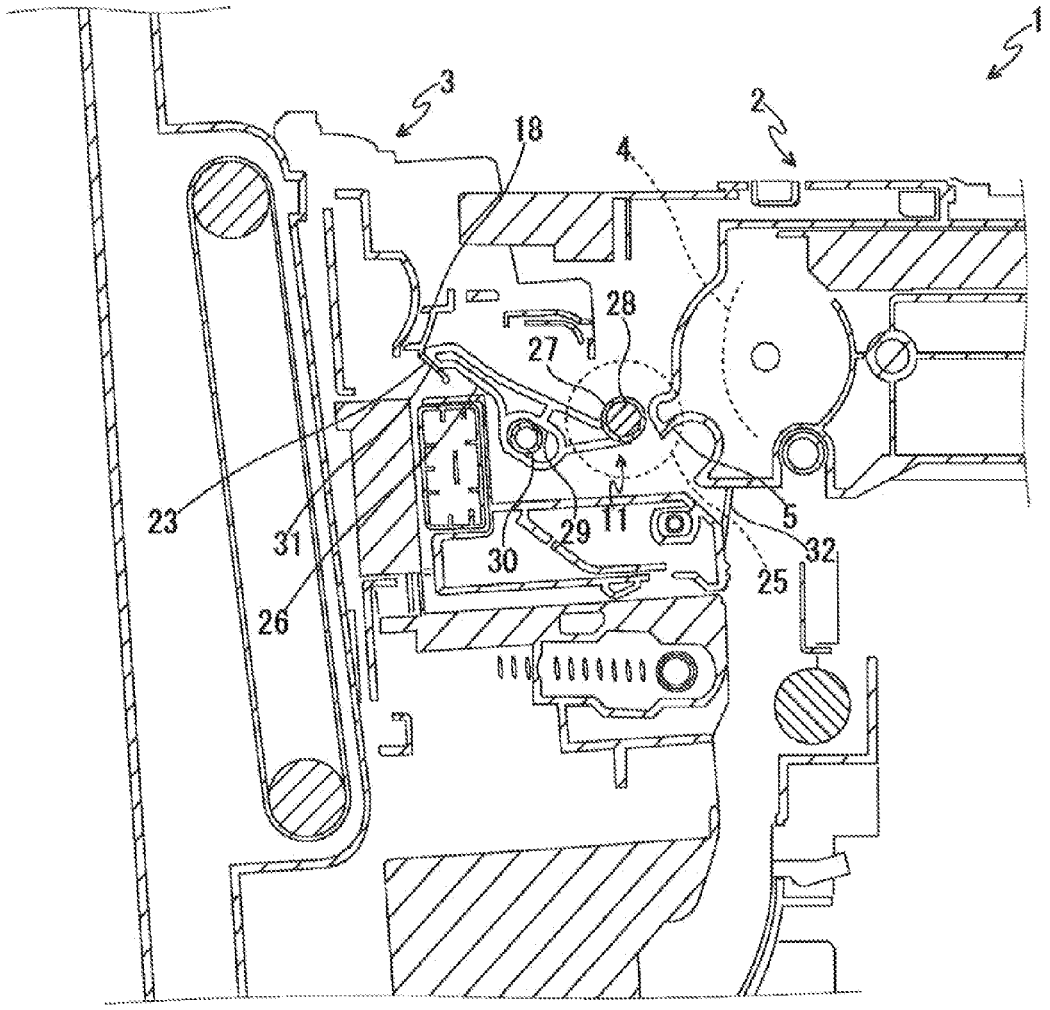
FIG. 13 is a sectional view of an image forming apparatus according to an embodiment of the present disclosure, and illustrates a section passing through a roller locating portion in a state in which the conveyance unit is largely open (open configuration).
Figure 14:
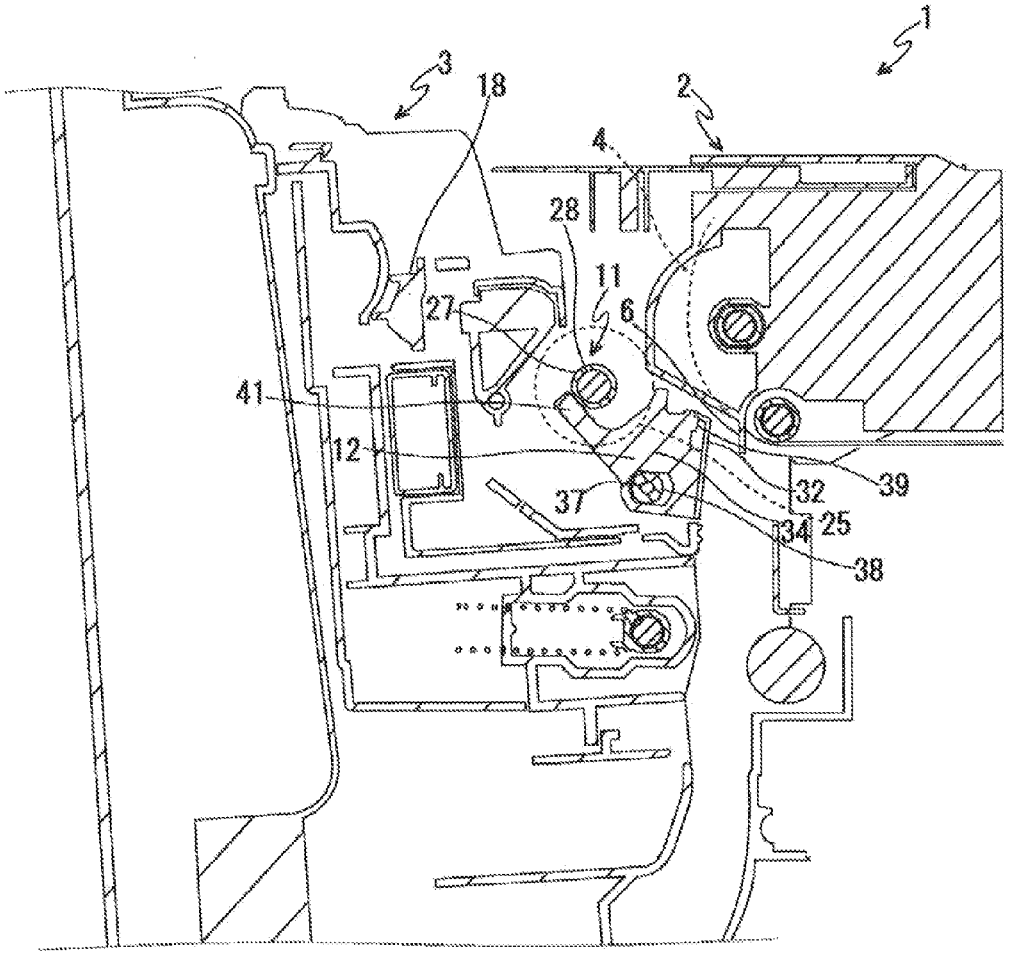
FIG. 14 is a sectional view of an image forming apparatus according to an embodiment of the present disclosure, and illustrates a section passing through a guide locating portion in a state in which the conveyance unit largely open (open configuration).

When a user opens the conveyance unit 3 further from this state to a largely opened configuration, as illustrated in FIG. 13, the pivotal supporting portion 27 of the separation lever 26 becomes completely separated from the roller locating portion 5. As illustrated in FIG. 14, the conveyance guide 12 is further separated from the guide locating portion 6. In this manner, in the present embodiment, the separation operation from the roller locating portion 5 of the secondary transfer roller 25 is operably connected to the separation from the guide locating portion 6 on the conveyance guide 12. Therefore, resistance during opening of the conveyance unit 3 is reduced, and contact between the transfer surface of the transfer roller 25 and the conveyance guide 12 can be prevented.

Next, the operation of displacing the conveyance unit 3 from an open state to a closed state will be described.

Firstly, when a user closes the conveyance unit 3 from a state in which the conveyance unit 3 is largely open (refer to FIG. 13 and FIG. 14), as illustrated in FIG. 11, the pivotal supporting portion 27 of the separation lever 26 displaces to the outer side of the roller locating portion 5. At that time, the pivotal supporting portion 27 of the separation lever 26 abuts with the regulating portion 41 of the conveyance guide 12, and thereby regulates the revolution (rotation) of the conveyance guide 12 towards the guide locating portion 6 due to the biasing force of the torsion spring. As a result, as illustrated in FIG. 12, the abutment piece 39 of the conveyance guide 12 maintains a state of separation with the guide locating portion 6 of the main body 2.

When a user closes the closure of the conveyance unit 3 further from this state, as illustrated in FIG. 9, the pivotal supporting portion 27 of the separation lever 26 faces to the roller locating portion 5. The pivotal supporting portion 27 of the separation lever 26 displaces to the opposite position from the roller locating portion 5. At the same time, as illustrated in FIG. 10, the abutment piece 39 of the conveyance guide 12 abuts with the guide locating portion 6 of the main body 2.

When the conveyance unit 3 is completely closed (when displacing to a closed state), as illustrated in FIG. 1, the pivotal supporting portion 27 of the separation lever 26 engages with the roller locating portion 5. The pivotal supporting portion 27 of the separation lever 26 displaces by revolving (rotating) from a separation position with the roller locating portion 5 to an engagement position. In this manner, the secondary transfer roller 25 is positioned. The pivotal supporting portion 27 separates from the regulating portion 41 as a result of the displacement by revolving (rotating) of the pivotal supporting portion 27, and the conveyance guide 12 abuts with the guide locating portion 6 as a result of the biasing force of the torsion spring. The conveyance guide 12 is maintained in a state of abutment with the guide locating portion 6. In this manner, the rear end side of the conveyance guide 12 is located by the guide locating portion 6 and the rear end boss 38 and the conveyance unit 3. The front end of the conveyance unit 12 is located vertically and transversely in the same orientation as the rear end by the guide locating portion 6 and the front end boss 38 and the conveyance unit 3. The secondary transfer nip portion 24 is formed by abutment of the secondary transfer roller 25 at a predetermined pressure with the intermediate transfer belt 4.

As described above in this embodiment, when the conveyance unit 3 is displaced from an open state to a closed state, the displacement by revolving (rotating) of the conveyance guide 12 towards the guide locating unit 6 due to the biasing force of the torsion spring is regulated due to abutment by the pivotal supporting portion 27 of the separation lever 26 with the regulating portion 41 of the conveyance guide 12. As a result, inadvertent revolution (rotation) of the conveyance guide 12 toward the guide locating portion 6 and abutment of the conveyance guide 12 with the guide locating portion 6 at a different position to the expected position can be prevented. Therefore, the color printer 1 (image forming apparatus) according to the present embodiment is configured to enable accurate and stable abutment of the conveyance guide 12 with the guide locating portion 6 of the main body 2, and thereby prevent unsatisfactory image quality, paper jams, and malfunction in relation to opening and closing operations. As described above, since the color printer 1 (image forming apparatus) is configured to operably connect the locating operation in relation to the secondary transfer roller 25 and the conveyance guide 12, locating of both members can be more accurately executed.

In the present embodiment, although a color printer was described as an image forming apparatus, there is no particular limitation in this regard, and the image forming apparatus may be a monochrome printer, a monochrome or color copying machine, a facsimile, or a multifunction peripheral combining such devices. The image forming apparatus may be a so-called electrographic type of image forming apparatus.

What is claimed is:

1. An image forming apparatus comprising a main body and a conveyance unit, the main body including:

an image carrier having one or a plurality of mutually parallel shafts, and forming a toner image on a surface;

a roller locating portion formed on both axial ends of the image carrier;

a guide locating portion formed in proximity to the roller locating portion, the conveyance unit mounted to open and close on the main body, and including:

a transfer roller unit having a transfer roller abutting with the image carrier and forming a transfer nip portion with the image carrier, and a separation lever configured to provide pivotal support for the transfer roller and being disposed to rotate;

a conveyance guide configured to guide a sheet of paper to the transfer nip portion, the conveyance guide including a regulating portion and being disposed to rotate; and a biasing member configured to bias the conveyance guide toward the guide locating portion, wherein when the conveyance unit is changing from an open state to a closed state, the separation lever in the transfer roller unit rotates and moves to face the roller locating portion in a state of abutment with the conveyance guide;

the conveyance guide rotates and moves in a state in which displacement towards the guide locating unit due to a biasing force of the biasing member is regulated by the separation lever; and when the conveyance unit changes to the closed state, the separation lever separates from the conveyance guide and engages with the roller locating portion; and the conveyance guide abuts with the guide locating portion due to the biasing force from the biasing member.

2. The image forming apparatus according to claim 1, wherein when the conveyance unit is in the open state, a portion of the separation lever is configured to be at a position separated from the roller locating portion; and the conveyance guide is configured to be at a position separated from the guide locating portion.

3. The image forming apparatus according to claim 1, wherein one longitudinal end of the conveyance guide is supported pivotally by the conveyance unit, and the other end is supported pivotally and movably in a predetermined direction by the conveyance unit.

4. The image forming apparatus according to claim 1, further comprising an opening and closing lever for opening the conveyance unit, wherein the transfer roller separates from the roller locating portion in connection with operation of the opening and closing lever.

5. An image forming apparatus comprising a main body and a conveyance unit, the main body including:

an image carrier having one or a plurality of mutually parallel shafts, and forming a toner image on a surface;

a roller locating portion formed on both axial ends of the image carrier;

a guide locating portion formed in proximity to the roller locating portion, the conveyance unit mounted to open and close on the main body, and including:

a transfer roller unit having a transfer roller abutting with the image carrier and forming a transfer nip portion with the image carrier, and a separation lever configured to provide pivotal support for the transfer roller and being disposed to rotate;

a conveyance guide configured to guide a sheet of paper to the transfer nip portion, the conveyance guide including a regulating portion and being disposed to rotate; and a biasing member configured to bias the conveyance guide toward the guide locating portion, wherein the separation lever includes a pivotal support portion that provides pivotal support for a shaft of the transfer roller; and when the conveyance unit is in an open state, or changing from the open state to a closed state, the pivotal support portion regulates rotation and displacement of the regulating portion; and when the conveyance unit is in the closed state, the pivotal support portion is located by the roller locating portion;

the pivotal support portion releases regulation on the regulating portion; and the conveyance guide of the transfer roller is located with respect to the guide locating portion by the biasing force from the biasing member.

6. The image forming apparatus according to claim 5, wherein when the conveyance unit is in the open state, a portion of the separation lever is configured to be at a position separated from the roller locating portion; and the conveyance guide is configured to be at a position separated from the guide locating portion.

7. The image forming apparatus according to claim 5, wherein one longitudinal end of the conveyance guide is supported pivotally by the conveyance unit, and the other end is supported pivotally and movably in a predetermined direction by the conveyance unit.

8. The image forming apparatus according to claim 5, further comprising an opening and closing lever for opening the conveyance unit, wherein the transfer roller separates from the roller locating portion in connection with operation of the opening and closing lever.

* * * * *